United States Patent [19]

Figueras et al.

[11] 3,948,750

[45] Apr. 6, 1976

[54] HOLLOW BIPOLAR ELECTRODE

[75] Inventors: Wilfredo E. Figueras, Amherst; Edward H. Cook, Jr., Lewiston, both of N.Y.

[73] Assignee: Hooker Chemical & Plastics Corporation, Niagara Falls, N.Y.

[22] Filed: May 28, 1974

[21] Appl. No.: 474,115

[52] U.S. Cl. ..... 204/286; 204/254; 204/268; 204/282; 204/290 R; 204/290 F

[51] Int. Cl.[2] ..... C25B 11/02; C25B 11/04

[58] Field of Search ..... 204/268, 290 F, 254, 255, 204/290 R, 286

[56] References Cited

UNITED STATES PATENTS

| | | | |
|---|---|---|---|
| 3,291,714 | 12/1966 | Hall et al. | 204/256 |
| 3,441,495 | 4/1969 | Colman | 204/268 |
| 3,632,497 | 1/1972 | Le Duc | 204/263 |
| 3,755,105 | 8/1973 | Messner | 204/95 |
| 3,759,813 | 9/1973 | Raetzsch et al. | 204/256 |
| 3,824,173 | 7/1974 | Bouy et al. | 204/284 |

FOREIGN PATENTS OR APPLICATIONS

| | | | |
|---|---|---|---|
| 1,421,051 | 7/1970 | Germany | 204/268 |

*Primary Examiner*—F. C. Edmundson
*Attorney, Agent, or Firm*—Peter F. Casella; Herbert W. Mylius

[57] ABSTRACT

A hollow bipolar electrode which comprises an anode structure and a cathode structure, said anode structure and cathode structure are in electrically conductive communication with each other and are fabricated from suitable anode and cathode materials respectively.

6 Claims, 10 Drawing Figures

HOLLOW BIPOLAR ELECTRODE

BACKGROUND OF THE INVENTION

This invention relates to bipolar electrode and to their use in bipolar electrolytic cells. More particularly, this invention relates to bipolar electrodes and their use in bipolar electrolytic cells suited for use in processes which involve the electrolysis of alkali metal halides to produce alkali metal halates, especially chlorates, such as sodium chlorate, alkali metal perhalates, halites and hypohalites.

Processes of this latter type utilize an electrolysis zone where most of the electrolytic reactions take place and, if needed, a reaction zone where certain chemical reactions, which are not electrolytic in nature, take place. Electrolyte is transferred from the electrolysis zone to the reaction zone, and in some instances, electrolyte is recycled from the reaction zone back to the electrolysis zone. In some processes, only the electrolysis zone is needed to produce the desired product.

In the production of a chlorate, for example, the principal reactions taking place in the electrolysis zone are:

Anodic $$2\,Cl \rightarrow Cl_2 + 2$$

$$Cl_2 + H_2O \leftrightharpoons HOCl + HCl$$

Cathodic $$2H^+ + 2e \rightarrow H_2$$

The principal reaction taking place in the reaction zone is:

$$2HOCl + OCl^- \rightarrow ClO_3 + 2HCl$$

In some instances, however, this latter reaction may also occur in the electrolysis zone.

The term "bipolar electrolytic cell" as used herein means an electrolytic cell in which at least one of the electrodes is bipolar, that is, one face or side functions as an anode and the other face or side functions as a cathode. In a bipolar electrolytic cell, each bipolar electrode is connected in series with the two electrodes that bracket or are adjacent to it. The two end or terminal electrodes are connected in series to a source of electricity. This is in contrast to a monopolar electrolytic cell in which all of the anodes are connected in parallel and all of the cathodes are connected in parallel to a source of electricity.

In general, bipolar electrolytic cells are advantageous over monopolar electrolytic cells because they are less complicated in design and are more economical to fabricate than are monopolar cells, e.g., they are more compact and require less copper for busbar connections because there are no busbar connections between the electrodes of the individual cells. Additionally, bipolar electrolytic cells can operate at lower voltages and at higher production rates per unit floor area, thus resulting in lower operating costs and lower capital investments. These are only a few of the many advantages offered by bipolar electrolytic cells over monopolar electrolytic cells.

Typically a bipolar electrolytic cell contains at least one bipolar electrode which is comprised of an anode plate and a cathode plate, joined together and in electrical contact with each other. The anode plate and the cathode plate are fabricated from suitable anodic and cathodic materials, respectively. Suitable materials for the anode plate are the valve metals, such as titanium, with a coating of a platinum-group metal and/or an oxide thereof applied to the anodic surface of the valve metal. The cathode plate is usually fabricated from a metal, such as steel, which is electrically conductive, resistant to corrosion by the electrolyte under cathodic conditions and resistant to reduction.

When bipolar electrodes are utilized in processes in which hydrogen is evolved at the cathode surface, they are subject to a disadvantage. During the electrolysis of an alkali metal halide in a bipolar electrolytic cell, for example, nascent hydrogen is formed at the steel cathode surface on the cathode side of a bipolar electrode. The hydrogen thus-formed permeates through the steel cathode and attacks the titanium or other valve metal on the anode side of the bipolar electrode, forming titanium hydride which causes blistering, embrittlement, flaking, misalignment and stress cracking of the titanium anode. The hydrogen also permeates through the titanium hydride because the initial formation of titanium hydride does not provide a barrier against further formation of titanium hydride. As the hydrogen permeates through the titanium hydride, more titanium hydride is formed and there is further deterioration of the titanium anode. This deterioration can eventually cause the titanium anode to separate from the steel cathode.

This deterioration of the titanium anodes significantly decreases the useful life of the bipolar electrodes, contaminates the products produced by the bipolar electrolytic cells and increases the casts of operating the cells. Although it is possible to use other cathode materials which are less permeable to hydrogen in place of steel, these materials are still permeable to hydrogen to some extent, so that steel is still the most economical and practical material to use as the cathode.

A novel bipolar electrode, suitable for use in a bipolar electrolytic cell, has now been developed which is substantially resistant to any deterioration caused by hydrogen permeation. This novel bipolar electrode of the present invention is a hollow bipolar electrode.

DESCRIPTION OF THE PRIOR ART

Hollow bipolar electrodes suitable for use in bipolar electrolytic diaphragm cells are disclosed in U.S. Pat. No. 3,778,362, issued Dec. 11, 1973 to Bayer. A typical bipolar electrode disclosed in this patent comprises a hollow steel spacer body inserted into a frame which is a non-conductor of electricity and is resistant to corrosion by the electrolyte. The anode, in the form of a flat plate, is attached to one end of the steel spacer body and the cathode, in the form of foraminous sheet, is attached to the other end of the steel spacer body. A steel sheet is inserted into and attached to the interior of the steel spacer body towards the anode end to separate the cathode zone from the anode end of the steel spacer body and thereby form a cathode chamber. Typically, the anode is titanium coated with a platinum-type metal, or oxide thereof or both and the cathode is preferably steel mesh which is covered with a suitable diaphragm. Two or more of the bipolar electrode units are joined together and are provided with suitable end electrodes and sealants to form a bipolar electrolytic diaphragm cell.

U.S. Pat. No. 3,759,813 issued Sept. 18, 1973 to PPG discloses a means of protecting a bipolar electrode which comprises providing a steel backing sheet on which the cathode is mounted, with a protective metal sheet and providing a space between the protective metal sheet and the steel backing sheet.

Bipolar electrode and bipolar electrolytic cells are also disclosed in U.S. Pat. Nos. 3,219,563; issued Nov. 23, 1965; 3,402,117, issued Sept. 17, 1968; 3,441,495, issued Apr. 29, 1969 and 3,451,914, issued June 24, 1969, which patents are cited herein to show the state of the art.

SUMMARY OF THE INVENTION

In accordance with the present invention, there is provided a hollow bipolar electrode which comprises an anode structure and a cathode structure. The anode structure and the cathode structure are in electrically conductive communication with each other and are fabricated from suitable anode and cathode materials, respectively. At least one of the anode structure or the cathode structure is concave in configuration or shape with respect to its inner surface so that a hollow space is formed within the bipolar electrode, between the anode and the cathode when they are assembled to form the bipolar electrode. The hollow electrode is provided with at least one suitable gas vent so that any gases, such as hydrogen, collected in the hollow space of the electrode, during electrolysis, can be adequately vented from the bipolar electrode. If desired, both the anode structure and the cathode structure can be concave or one structure can be concave and the other structure can be convex in configuration, with respect to their inner surfaces, to form the hollow space within the bipolar electrode. In a preferred embodiment, one structure, preferably the anode structure, is flat or plane in configuration or shape with respect to both its inner and outer surfaces and the other structure, preferably the cathode structure, is concave in configuration or shape with respect to its inner surface.

The anode structure is preferably fabricated from a non-foraminous valve metal base which has an electrically-conductive, anodically-resistant coating applied to its active anodic or unoxidized surface. Suitable valve metals include titanium, tantalum, niobium and zirconium. The preferred valve metal is titanium. The coating preferably contains one or more platinum-group metals, and/or platinum-group metal oxides. Suitable platinum-group metals include platinum, ruthenium, rhodium, palladium, osmium and iridium. Any of various methods can be used for applying the coating to the valve metal base. Typical methods include precipitation of the metals or metallic oxides by chemical, thermal or electrolytic processes, ion plating, vapor deposition or the like means.

The cathode structure is preferably fabricated from steel, however, chronium, cobalt, copper, iron, lead, molybdenum, nickel, tin, tungsten or alloys thereof can also be used. The cathode, like the anode is formed from a non-foraminous sheet or plate of metal.

The anode structure and the cathode structure are joined in any suitable manner, as by welding, bolting, clamping, riveting or the like, to form the hollow bipolar electrode of the present invention. The anode structure and the cathode structure are in electrically conductive communication with each other and their respective contacting surfaces are substantially free of any metal oxides or other contaminates that would reduce their electrical conductivity or the electrical conductivity of the hollow bipolar electrode.

The electrical conductivity between the anode structure and the cathode structure can be improved by applying a coating of a highly conductive metal, such as copper, silver, aluminum or an alloy thereof, to the contacting surface of the anode structure or the cathode structure or both. Any of various methods can be used for applying the highly conductive metal coating to either the anode structure or the cathode structure. Typical methods are precipitation of the metals by chemical, thermal or electrolytic means. The electrical conductivity between the anode structure and the cathode structure can also be improved by inserting strips of a highly conductive metal, such as copper, silver, aluminum or an alloy thereof, between the anode structure and the cathode structure.

A typical bipolar electrolytic cell can be assembled by arranging one or more of the hollow bipolar electrodes of the present invention in a row, wherein each bipolar electrode is positioned parallel to but spaced apart from its adjacent electrodes. Suitable spacer frames, which are non-conductors of electricity, are resistant to corrosion by the electrolyte and can withstand the operating temperatures of the bipolar electrolytic cell, can be used to separate each hollow bipolar electrode and the two terminal electrodes positioned at each end of the row of one or more hollow bipolar electrodes. The spacer frames can be fabricated from any suitable material which is a non-conductor of electricity, is resistant to corrosion by the electrolyte and can withstand the operating temperatures of the bipolar electrolytic cell of the present invention. Exemplary of such suitable materials are various thermoplastic or thermosetting resins, such as polypropylene, polybutylene, polytetrafluoroethylene, after chlorinated or rigid FEP, chlorendic acid based polyesters, and the like.

The spacer frames are provided with suitable entrance and exit ports to allow for circulation of the electrolyte through the bipolar electrolytic cell. Generally, the electrolyte will enter at the bottom of the cell and exit from the top of the cell, although other positions for such ports may also be used. Normally, the electrolyte passes through only one bipolar electrolytic cell unit. Suitable piping arrangements can be made, however, to enable the electrolyte to be circulated through more than one bipolar electrolytic cell unit.

A suitable gasket or sealant material, such as Neoprene, or other chloroprene rubbers, Teflon, or other fluorocarbon resins, or the like, can be placed between each electrode and frame to provide a gas and liquid tight seal. The individual electrodes and spacer frames comprising the bipolar electrolytic cell can be joined and held together by any suitable means, such as bolting, clamping, riveting or the like. A particularly preferred means of joining and holding the electrodes and spacer frames together is a filter press type arrangement wherein pressure means are applied to the end electrodes or suitable end pressure plates, to hold the entire cell assembly together as an operable unit.

In the drawings which are attached hereto and form a part hereof:

DETAILED DESCRIPTION OF THE DRAWINGS

Figure 1:
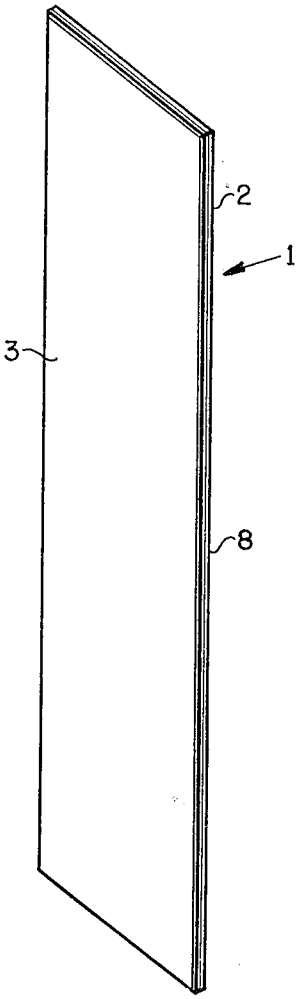
FIGS. 1 and 2 are, respectively, perspective views of a typical anode and cathode structure of the electrode of the present invention.

In FIG. 1, there is shown the anode structure, indicated generally as 1, for the bipolar electrode of the present invention. This anode structure comprises a non-foraminous sheet or plate 2 of a valve metal, such as titanium. One side of the titanium sheet contains an activating coating 3 of a platinum group metal or platinum group metal oxide, such as ruthinium oxide.

The choice of the particular valve metal for the sheet 2 and the particular noble metal or noble metal oxide for the coating 3 will be governed by the environment in which the electrode structure is to be used. Where the electrode is used in an electrolytic cell for the production of alkali metal halates, such as sodium chlorate, the preferred valve metal for sheet 2 is titanium and the preferred coating 3 is a mixed coating of ruthenium oxide and titanium oxide, such as that described in U.S. Pat. No. 3,632,498.

The side of sheet 2 that does not contain the activating coating 3, indicated as 8 in the drawing, which side is placed into electrically conductive contact with the cathode structure, may also contain a coating of a highly conductive metal, such as copper, silver, aluminum, or the like, to enhance the electrically conductive contact between the anode and cathode structure of the electrode.

Figure 2:
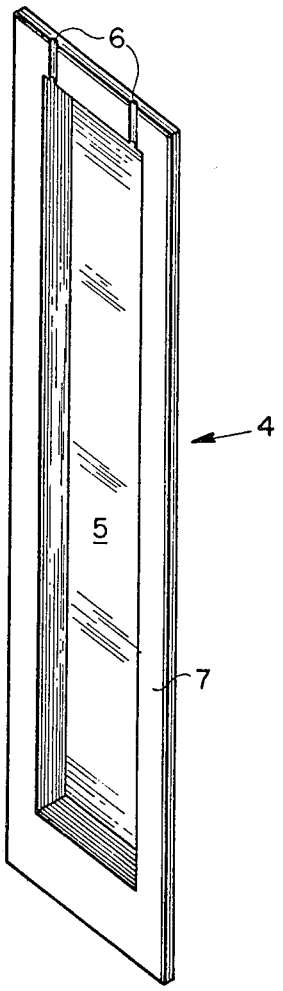

In FIG. 2, there is shown the cathode structure 4 which, like the anode, is non-foraminous and fabricated from a suitable metal, such as steel. The cathode 4 is formed with a central, concave portion 5 and gas release vents 6, which provide communication between this central concave portion and the exterior of the cathode, when the anode and cathode members are assembled into the electrode structure. The outer perimeter 7, of the cathode 4, which surrounds the central concave portion 5, is placed in electrically conducting contact with the surface 8 of the anode structure 1 when the cathode and anode members are assembled into the electrode of the present invention. This perimeter surface 7, like the surface 8 of the anode, may be provided with a coating of a more highly conductive metal, such as copper, silver, aluminum, or the like, to improve the electrical conductivity between the anode and cathode sections. Alternatively, as has been indicated hereinabove, this improvement in conductivity may be effected by inserting strips or the like of the more highly conductive metal between the surfaces 8 and 7, rather than coating the surfaces.

As with the anode member, although the preferred material of construction for the cathode member is steel, other metals, as have been indicated hereinabove, may also be used, depending upon the particular environment in which the electrode is to be used. It is, however, important that both the anode and cathode be formed of non-foraminous metal sheets or plates rather than from expanded metal, metal mesh or screen, or the like metal structures which contain a multiplicity of foramena or holes.

Figure 3:
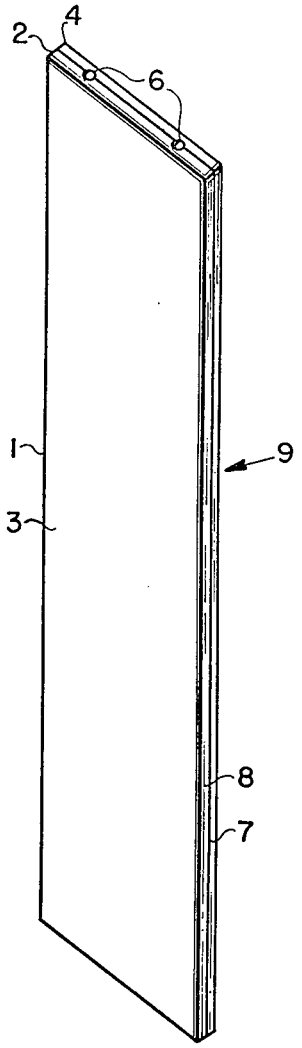
FIG. 3 is a perspective view of a typical assembled bipolar electrode.
Figure 9:
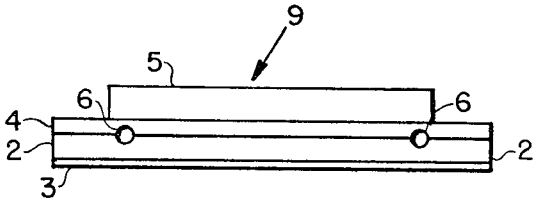
FIG. 9 is a top view of the electrode of FIG. 3.
Figure 8:
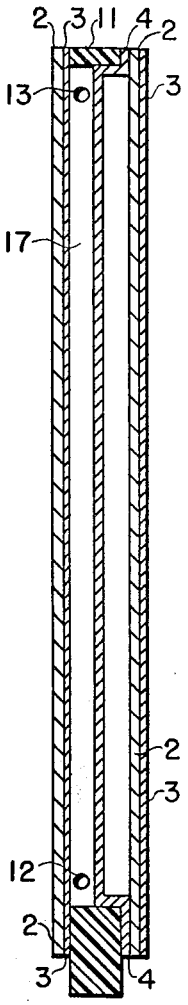
FIG. 8 is a cross section of a side elevation view of the cell unit of FIG. 7.

Referring now to FIGS. 3 and 9, these figures show the bipolar electrode 9 formed from the anode member 1 and the cathode member 4, shown in FIGS. 1 and 2. This bipolar electrode structure is fabricated by joining the anode and cathode members so that the surface 8 of the anode and the surface 7 of the cathode are in electrically conductive contact. The anode and cathode members may be joined in any suitable manner, such as by welding, bolting, clamping, riveting, or the like. In the assembled electrode, as can be seen most clearly in FIG. 9, the concave portion 5 of the cathode 4 is disposed on the side of the electrode opposite the electrically active coating 3 on sheet portion 2 of the anode. When assembled in this manner, there is formed a hollow, bipolar electrode structure in which the anodic reaction takes place at the noble metal or noble metal oxide coating 3 on the anode and the cathodic reaction takes place on the opposite side of the electrode on the surface of the concave portion 5 of the cathode.

Figure 4:
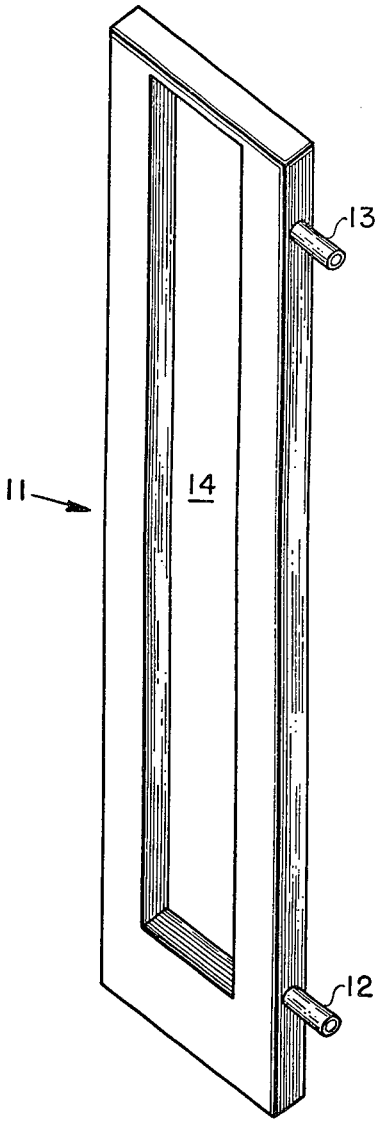
FIG. 4 is a perspective view of a typical spacer frame for use in the bipolar electrode of the present invention.
Figure 5:
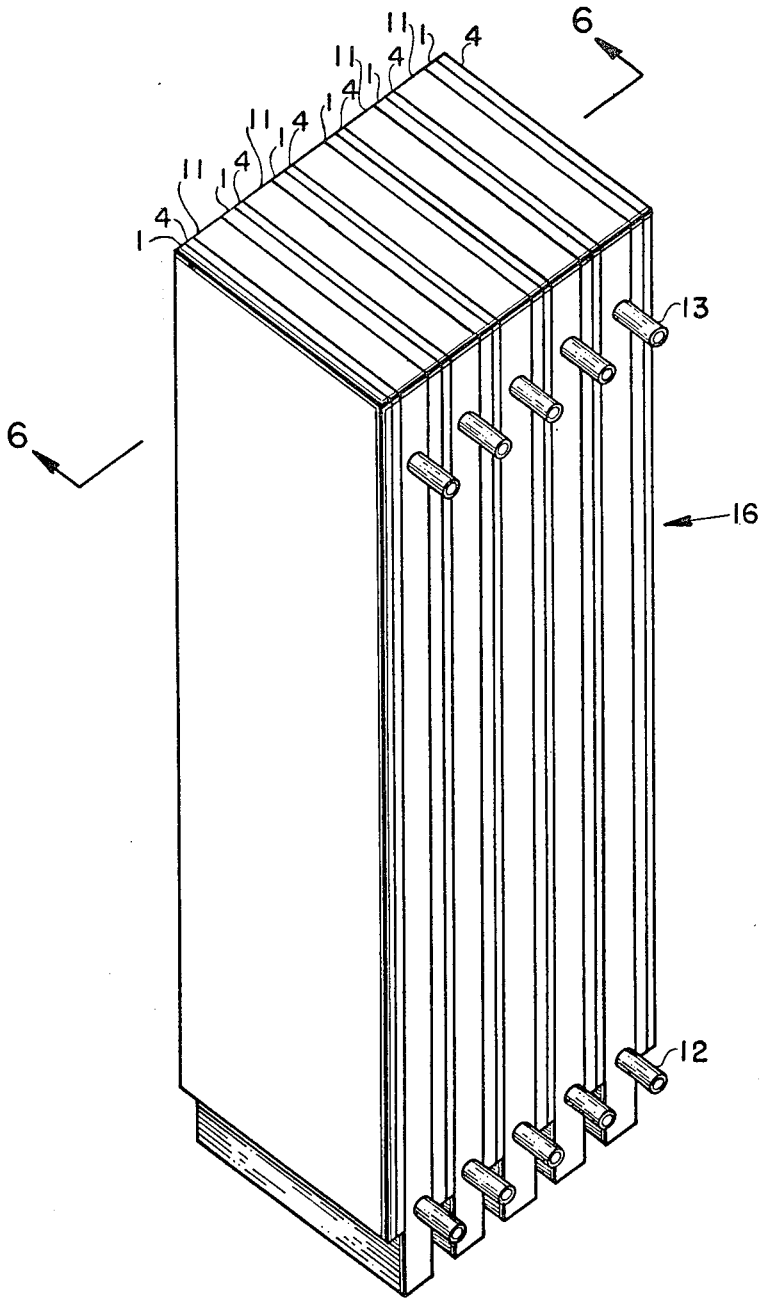
FIG. 5 is a perspective view of a typical assembled bipolar electrolytic cell.
Figure 6:
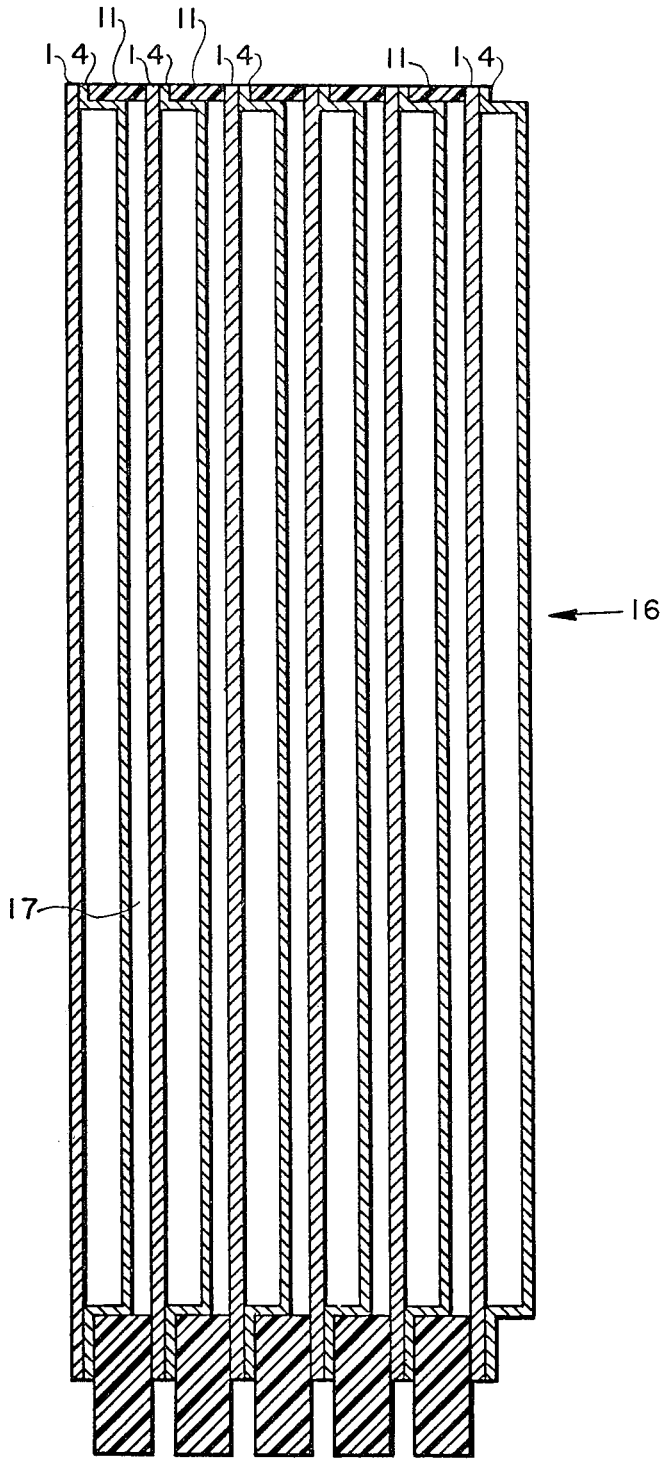
FIG. 6 is a sectional view of the cell of FIG. 5.
Figure 7:
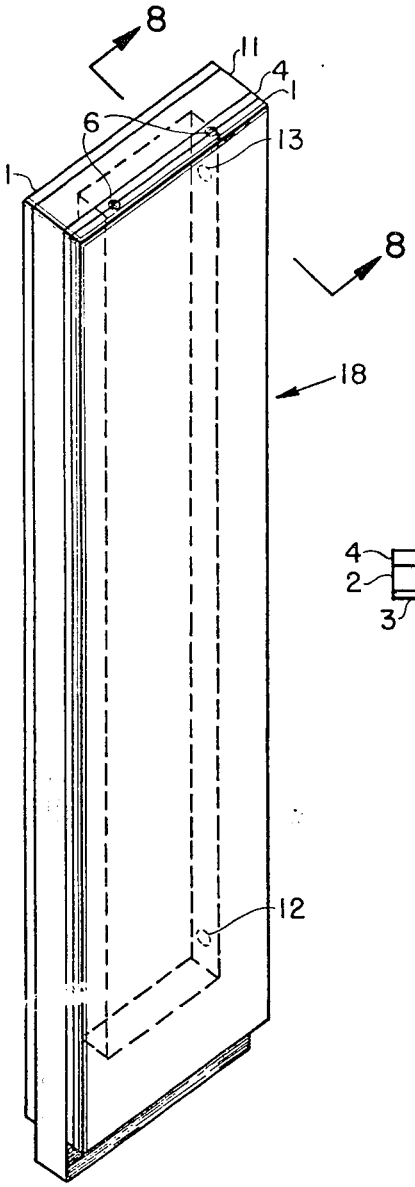
FIG. 7 is a perspective view of a typical single bipolar electrolytic cell unit.

In FIG. 4, there is shown a perspective view of a spacer frame 11 which may be utilized in an assembled bipolar cell to separate the bipolar electrode units which have been described above. The spacer frame is provided with a central cut-out portion 14, the size and shape of which is such as to accommodate the concave portion 5 of the cathode 4. Preferably, the spacer frame is fabricated from polypropylene, although other suitable materials which are electrically non-conductive and resistant to corrosion by the environment in which the spacer frame is used and which will withstand the operating temperatures of the cell, may also be utilized. The thickness of the spacer frame 11 is such that it is greater than the depth of the concave portion 5 of the cathode member 4 which is inserted into the cut-out portion 14 of the frame. Additionally, inlet and outlet ports 12 and 13, for electrolyte, are formed in that portion of the side edge of the frame which extends beyond the concave portion 5 of the cathode. In this manner, when the electrode members and the spacer frames are assembled into the bipolar cell, this extended portion of the frame maintains a space between the concave portion of one cathode member and the anode member of the next adjacent electrode, thus forming the electrolysis zone.

Referring now to FIGS. 5, 6, 7 and 8, these are perspective and sectional views of a bipolar electrolytic cell 16 and a bipolar electrolytic cell unit 18, formed from the bipolar electrode member and spacer frame member shown in FIGS. 3 and 4. The bipolar cell 16 and cell unit 18 assemblies are in the form of a filter press configuration comprised of a plurality of the bipolar electrode units 9 separated by the spacer elements 11. Suitable gasketing material may be provided between the various electrode and frame members as is necessary to provide a liquid and gas tight seal between these elements. The filter press assembly may be held together in any convenient manner, such as by means of bolts or tie rods or the like (not shown) or by means of a filter press frame whereby the electrode and spacer members are clamped together under sufficient pressure to prevent leakage, as is known in the art.

An electrolysis zone 17 is formed between the cathode 4 of one electrode member 9 and the anode 1 of the adjacent electrode member. Typically, the width of this electrolysis zone may be from about one quarter to one sixty-fourth of an inch, although the exact width may vary depending upon the size of the cell, the current load and the type of electrolyte which is to be processed. Electrolyte inlets and outlets 12 and 13 respectively, are provided in the electrolysis zone 17, which inlets and outlets are formed in that portion of the sidewalls of the spacer frame 11 which extends beyond the concave portion 5 of the cathode 4. Although only one such inlet and outlet has been shown, additional ones may be provided if desired. Additionally, as is shown most clearly in FIG. 7, gas vents 6, which communicate with the hollow interior of the electrode unit 9 are also provided so as to effect the release of gases, particularly hydrogen, which permeate the steel cathode 4 during the electrolysis. In this way, the attack by the hydrogen on the titanium anode is greatly minimized, if not substantially prevented.

In the operation of the cell, for the production of sodium chlorate, a source of direct current is connected, in series, with the anode member at one end of the cell stack and with the cathode member at the opposite end. A sodium chloride brine is introduced into the electrolyte inlets 12 of each cell unit where it passes through the electrolysis zone 17 and is removed from the cell through the electrolyte outlets 13. Within the electrolysis zone, the sodium chloride brine is electrolytically decomposed into chlorine at the anode and sodium hydroxide at the cathode, which react to form hydrochlorous acid and/or sodium hypochlorite, which in turn is reduced to sodium chlorate. Depending upon the size of the cell and the residence time of the electrolyte within the cell, this formation of chlorate may be substantially accomplished within the cell itself. Generally, however, the reaction to form the chlorate is completed outside of the cell, either in a batch type process or in a continuous process in which the sodium chlorate solution is reintroduced into the cell with the sodium chloride electrolyte.

Figure 10:
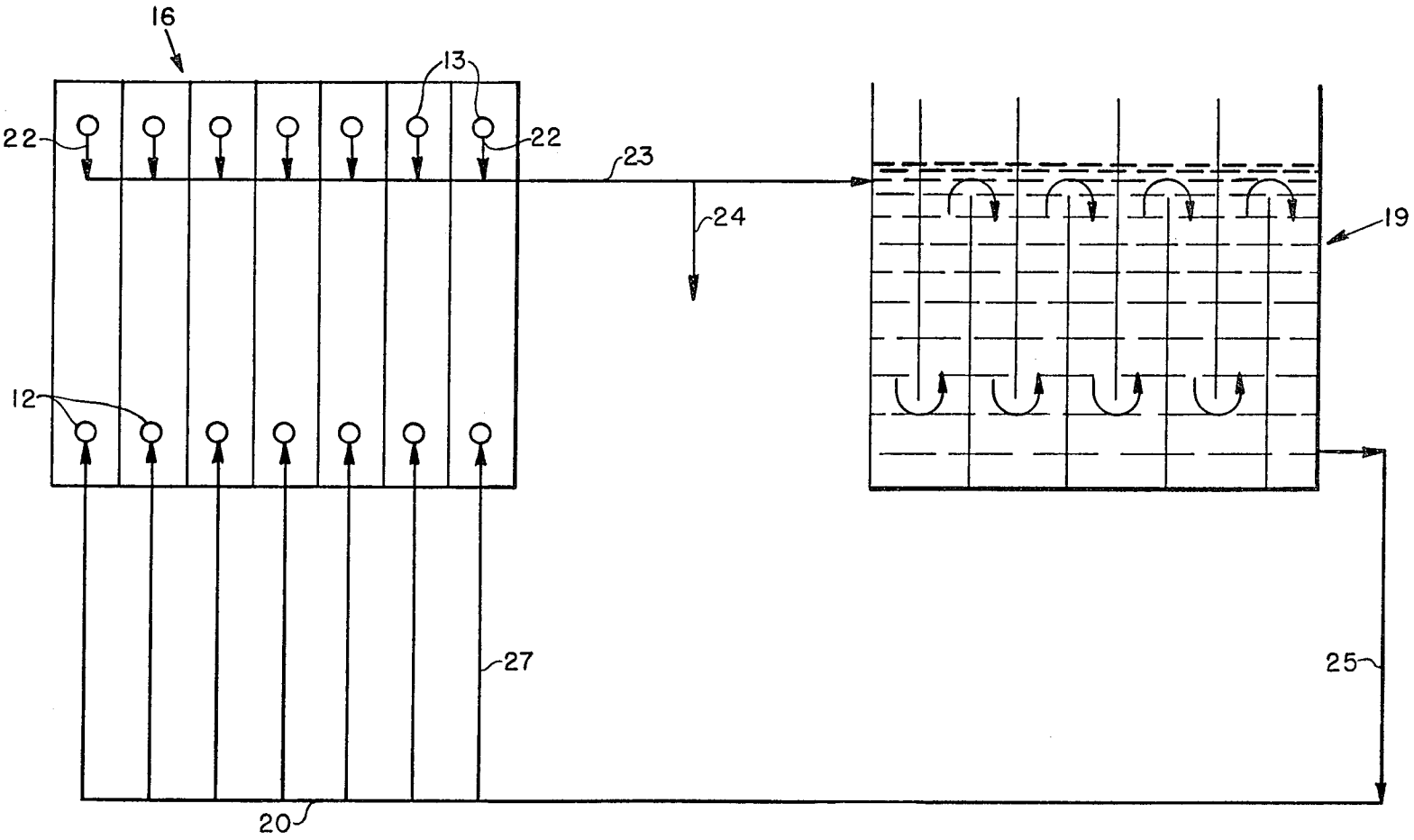
FIG. 10 is a schematic representation of the bipolar electrolytic cell of the present in conjunction with a reaction tank.

Referring now to FIG. 10, this is a schematic representation of a preferred method of continuously operating the cells of the present invention to produce sodium chlorate. As is shown in this Figure, the electrolyte is continuously introduced through inlet lines 27 into the inlet ports 12 of the bipolar electrolytic cell 16 of the present invention. The electrolyte is removed from the cell through the outlet ports 13, through lines 22 and 23 to reaction tank 19. The electrolyte solution, which contains hypochlorous acid and sodium hypochlorite, passes through the baffled sections of the reaction tank, wherein the formation of the sodium chlorate is completed. The chlorate containing solution is then removed from the reaction tank 19 through line 25 and is then reintroduced into the cell through line 20 and 27. This process is continued until the desired concentration of chlorate in the electrolyte is achieved, at which point a portion of the sodium chlorate containing electrolyte is then removed through line 34 as the product of the process. In this manner, by the use of the bipolar electrode structure of the present invention, it is found that the desired sodium chlorate product is economically produced and that the problem of the hydrogen embrittlement of the titanium or similar valve metal anode is substantially overcome.

Although the bipolar electrodes of the present invention are particularly suited for use in the production of sodium chlorate, they may also be used in other electrolytic processes as well. Typical of such other processes are the electrolytic production of chlorine and caustic soda, in a diaphragm or ion exchange membrane type cell; the electrolytic production of persulfates or perborates; the electrolytic oxidation of organic compounds; fuel cells; electrolytic desalination and purification of water; galvanic processes and the like. For such other uses, the materials of construction used for the anode and cathode members of the electrode will, of course, be selected so as to be suitable in the environment and under the particular conditions that are encountered.

While there have been described various embodiments of the invention, the apparatus described in not intended to be understood as limiting the scope of the invention as it is realized that changes therewithin are possible and it is intended that each element recited in any of the following claims is to be understood as referring to all equivalent elements for accomplishing the same results in substantially the same or equivalent manner, it being intended to cover the invention broadly in whatever form its principle may be utilized.

What is claimed is:

1. A hollow bipolar electrode, which electrode comprises an anode member and a cathode member, each of which are formed of non-foraminous metal, said anode and cathode members being joined together in electrically conductive contact, at least one of said members having a concave portion which, when said members are so joined together, forms a hollow section in the interior of said bipolar electrode and, at least one gas vent between the interior of said hollow section and the exterior of said electrode, said vent or vents effecting the release of gases from the interior of said hollow section.

2. The electrode as claimed in claim 1 wherein said anode member is substantially planar in configuration and the cathode member is joined thereto in electrically conductive contact only around its outer periphery, the central portion of said cathode member being concave with respect to said planar anode member.

3. The electrode as claimed in claim 2 wherein the anode member if formed of a valve metal and has an electrically conductive, anodically resistant coating on at least a portion of its exterior surface.

4. The electrode as claimed in claim 3 wherein the valve metal is selected from titanium, tantalum and niobium and the electrically conductive coating contains at least one material selected from platinum group metals and platinum group metal oxides.

5. The electrode as claimed in claim 4 wherein the cathode member is formed of a metal selected from iron, steel, chromium, cobalt, copper, lead, molybdenum, nickel, tungsten and alloys thereof.

6. The electrode as claimed in claim 5 wherein the cathode member is steel.

* * * * *

UNITED STATES PATENT AND TRADEMARK OFFICE

CERTIFICATE OF CORRECTION

PATENT NO. : 3,948,750

DATED : April 6, 1976

INVENTOR(S) : Wilfredo E. Figueras and Edward H. Cook, Jr.

It is certified that error appears in the above-identified patent and that said Letters Patent are hereby corrected as shown below:

| | | |
|---|---|---|
| Column 1, | Line 30 | $Cl_2$+2 should appear $Cl_2$+2e |
| | Line 40 | $ClO_3$ should appear as $ClO^-_3$ |
| Column 2, | Line 37 | "casts" should appear as ---costs--. |
| Column 3, | Line 60 | "chronium" should appear as --chromium--. |
| Column 5, | Line 25 | "ruthinium" should appear as --ruthenium--. |
| Column 7, | Line 63 | numeral "34" should appear as --24--. |
| Column 8, | Line 21 | "in" should appear as --is--. |

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*